US005853451A

United States Patent [19]

Ishikawa

[11] Patent Number: 5,853,451

[45] Date of Patent: Dec. 29, 1998

[54] ULTRAFINE SPHERICAL NICKEL POWDER FOR USE AS AN ELECTRODE OF LAMINATED CERAMIC CAPACITORS

[75] Inventor: Hiroyuki Ishikawa, Chiba, Japan

[73] Assignee: Kawasaki Steel Corporation, Japan

[21] Appl. No.: 537,477

[22] Filed: Oct. 2, 1995

Related U.S. Application Data

[63] Continuation-in-part of Ser. No. 220,474, Mar. 31, 1994, abandoned, which is a continuation-in-part of Ser. No. 711,804, Jun. 7, 1991, abandoned.

[30] Foreign Application Priority Data

Jun. 12, 1990 [JP] Japan ..... 2-151645

[51] Int. Cl.[6] ..... B22F 1/00

[52] U.S. Cl. ..... 75/367; 75/363; 75/369; 75/953; 148/426

[58] Field of Search ..... 75/342, 363, 367, 75/369, 370, 953; 148/426

[56] References Cited

U.S. PATENT DOCUMENTS 4,383,852 5/1983 Yoshizawa ..... 75/363

4,810,285 3/1989 Otsuka et al. ..... 75/369

*Primary Examiner*—Sikyin Ip

*Attorney, Agent, or Firm*—Austin R. Miller

[57] ABSTRACT

Ultrafine spherical nickel powder for use in a laminate ceramics capacitor is produced through a process employing a vapor phase chemical reaction between nickel chloride and hydrogen. The process includes the steps of: i) charging a reaction vessel with nickel chloride and evaporating the nickel chloride to generate vapor of nickel chloride; ii) mixing an inert gas with the vapor of the nickel chloride to form a mixture gas having a nickel chloride gas concentration of 0.05 to 0.3, and sending the mixture gas to a reaction zone; iii) bringing, in the reaction zone, the mixture gas into contact and mixing with hydrogen which is supplied from a nozzle at a temperature of 1004° C. to 1453° C., in such a manner that the flow rate ratio of the hydrogen to the mixture gas meets the condition of $(H_2/(NiCl_2+\text{inert gas}))<1$, thereby causing the chemical reaction; and iv) cooling the generated ultrafine nickel powder together with the gas and collecting the ultrafine nickel powder.

5 Claims, 1 Drawing Sheet

ULTRAFINE SPHERICAL NICKEL POWDER FOR USE AS AN ELECTRODE OF LAMINATED CERAMIC CAPACITORS

This application is a continuation-in-part of application Ser. No. 08/220,474, filed Mar. 31, 1994, now abandoned, which was a continuation-in-part of application Ser. No. 07/711,804, filed Jun. 7, 1991, now abandoned.

This invention relates to a high-purity ultrafine spherical powder of nickel suitable for making a conductive paste filler for use in electronic parts or the like. The invention also relates to a novel method of making the new nickel powder.

Ultrafine metallic powders according to this invention consist of spherical particles having limited dispersion of particle size, i.e. having an average particle size in the range of about 0.1 to several microns. The expression "particle size", as used herein, is intended to mean the average diameter of the surface area of the particles. Ultrafine metallic powders according to this invention have improved paste properties and, when used to form conductors in an electronic circuit, enable formation of fine conductor patterns and also enable reduction in the thicknesses of conductor layers. Such powders are therefore in much demand.

BACKGROUND OF THE INVENTION

Laminated ceramic capacitors used as electronic circuit components are generally manufactured in such a manner that layers of ceramic dielectric are alternately layered with internal electrodes and the resulting layered structure is pressed and fired so as to be integrally combined. In such a case it is necessary to use, as an internal electrode material, a precious metal such as Pt or Pd which does not melt at the temperature at which the dielectric ceramic is sintered, which does not decompose or reduce the dielectric ceramic, and which does not oxidize by firing in an atmosphere having a high oxygen partial pressure. Where such an expensive material is used, it is difficult to manufacture a large-capacity low-price capacitor.

In an effort to solve this problem a ceramic has been developed which enables use of a base metal as the internal electrodes, which base metal is not changed into a semiconductor by firing in an atmosphere of low oxygen partial pressure or in a reducing atmosphere, and which has excellent dielectric characteristics and a specific resistance sufficient for use as a dielectric for capacitors.

With recent progress of the development of small large-capacity electronic parts, a need for reduction of thickness and of resistance of the internal electrodes has arisen.

The thickness of an internal electrode is limited by the particle size of the filler used in the paste. This thickness cannot be smaller than the particle size itself. Accordingly, a filler powder having a smaller particle size may be used to afford reduction of thickness. However, there is a practical limit to the available amount of reduction of particle size, because the filling properties of the filler deteriorate if the particles are too small.

A method of manufacturing an ultrafine nickel powder is disclosed in Japanese Patent Publication No. 59-7765. Nuclei of the metal generated in interface unstable regions are grown to form ultrafine powder particles by controlling differences between the flow rates of a metal halide gas and a reducing gas and by utilizing the difference between the specific gravities of the gases to form an ultrafine nickel powder. In such a case particles having a crystal habit such as a cubic shape (noted in Table 1 of the reference) are formed into a nickel powder. Such particles, while less expensive than previous metal powders, cause a filling problem when the powder is used as a paste filler.

A similar method of obtaining an ultrafine nickel powder utilizes a vapor phase hydrogen reduction reaction of nickel chloride. Such method is disclosed in the thesis "Manufacture of ultrafine particles of nickel, cobalt or iron by vapor phase hydrogen reduction of chloride" (Journal of Nihon Kagaku Kai, 1984, (6), pp 867 to 878) authored by Kenichi Ohtsuka et al. In this method, a reaction is effected at a temperature of 750° C. to 950° C. and a chloride vapor density of 0.02 or lower to obtain an ultrafine powder having a particle size of 0.1 $\mu$m or smaller. This method also entails a serious problem because of formation of particles having crystal habits.

Japanese Patent Publication No. 2-49364 discloses a method in which a reducing agent such as sodium boron hydride is added to a water solution containing nickel ions to reduce and precipitate nickel. This method entails problems including a need for various reducing agents, complicated manufacturing conditions, and a need to use an expensive high-purity reducing agent for obtaining a high-purity product. This reducing precipitation method uses a batch type process which is difficult to practice as a continuous process.

The so-called carbonyl method is known among other methods for manufacturing very fine powders of nickel and iron. However, this method cannot satisfy demands for finer or thinner conductor patterns because the particle size attained by this method is too large.

Japanese Patent Laid-Open Nos. 62-63604 and 62-188709 disclose methods for manufacturing powders of copper and silver. According to these methods a metal halide is vaporized, the vapor of the metal halide is supplied to a reaction section by its vapor pressure or by an inert gas carrier, and the metal halide vapor and a reducing gas (such as hydrogen gas) are brought into contact and mixed with each other in the reaction section. Particles of the metal are thereby immediately reduced and separated out in the gas and discharged through an outlet together with the gas. It is thus possible to continuously supply the raw-material metal halide and to continuously collect the formed powder.

In comparison with the copper powder in Japanese Patent Laid Open No. 62-63604and the silver powder in Japanese Patent Laid Open No. 62-188709, nickel powders formed by conventional methods include particles having cubic, octahedral and other crystal habits, which crystal habits create a major problem in terms of filling when the powder is used as a paste filler.

Japanese Patent Laid-Open No. 1-136910 discloses a method for producing by a wet process nickel powder having a purity of 99% or higher and a particle size ranging between 0.1 and 3.0 $\mu$m. JP '910 does not, however, definitely state that the paste was actually prepared and used as an electrode of an electronic part. According to an investigation made by the inventor, however, delamination and crack formation tend to occur in the firing step in the course of production of laminated ceramic capacitors using a paste prepared from nickel powder prepared by the conventional wet process, due to large changes in volume which occur during firing. This is attributable to the fact that oxidation expansion or excessive sintering takes place during firing because the crystals do not grow large (aggregate of fine primary grains) due to low temperatures (under 100° C.).

Japanese Patent Laid-Open No. 64-80007 discloses an electrode paste for use in the production of a ceramic capacitor, employing Ni powder of an average particle size of 1.0 μm and purity of 99.9% or higher. JP '007 shows addition of carbide powder into the paste for the purpose of prevention of crack formation and delamination during firing. It does not show the influence of characteristics of Ni powder but shows that prevention of crack formation and delamination during firing is one of the most important requirements in the production of ceramic capacitors. Thus, there has been a demand for development of Ni powder as an electrode material which has a reduced tendency of crack formation and delamination.

Accordingly, it has been a serious drawback that fine nickel powders manufactured by conventional methods include particles having undesirable crystal habits when the particle size is reduced to about 1 μm or smaller. The filling properties and performance of the resulting fillers at the time of internal electrode paste printing have been found to be unsatisfactory. Serious problems of low filler density, large amounts of voids formed by firing, and increase in electrical resistance have accordingly been encountered. There is also an increased possibility of delamination of the resulting layered structure at the time of firing. No nickel powder has heretofore been provided which has a particle size of 3 μm or smaller and has a satisfactorily high purity. Known nickel powder fillers used as components of electronic parts cannot be improved to provide a reduction in the resistance of the electrodes or by preventing undesirable influences on the dielectric.

SUMMARY OF THE INVENTION

In view of these problems, an object of the present invention is to provide an ultrafine spherical nickel powder for use as an electrode in a laminated ceramic capacitor, the ultrafine spherical nickel powder having an average particle size of 0.2 to 3 μm and a geometrical standard deviation of particle size distribution not more than 2.0, wherein the ratio of the average grain size to the average particle size is not less than 0.2 and nickel content is not less than 99.5 wt %.

DESCRIPTION OF THE PREFERRED EMBODIMENTS

Figure 1:
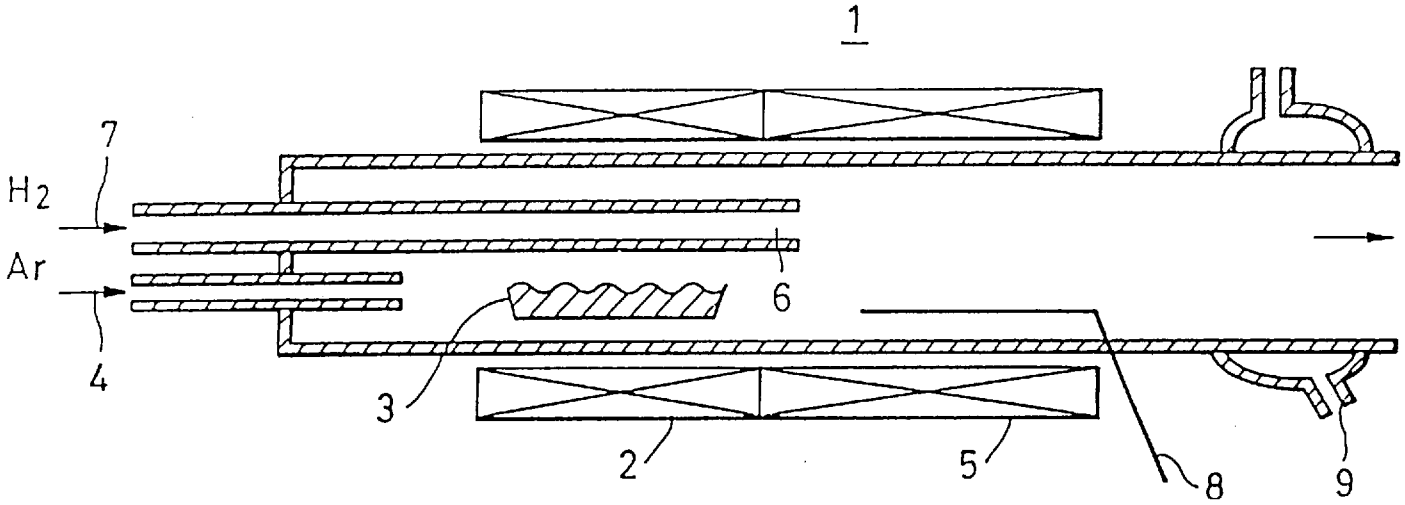
FIG. 1 is a schematic diagram of a reactor suitably used to carry out the method according to this invention.

The present invention relates to a method of manufacturing an ultrafine spherical nickel powder containing 99.5% or more by weight of nickel (about 99.5%–100%) in which nickel chloride vapor and hydrogen are reacted while controlling the nickel chloride vapor density in the range of about 0.05 to 0.3 and the reaction temperature in the range of about 1,004° C. (1,277° K.) to 1,453° C. (1,726° K.). This invention further relates to an ultrafine spherical nickel powder formed of substantially spherical particles having a particle size of about 0.2 to 3 μm and containing about 99.5% or more by weight of nickel.

The present invention further relates to an ultrafine spherical nickel powder formed by chemical vapor phase reaction of nickel chloride with hydrogen and to a method of manufacturing this powder.

To manufacture an ultrafine nickel powder by chemical vapor phase reaction, nickel chloride which is diluted with inert gas, such as argon, is brought into contact with and mixed with hydrogen and is reacted. Ultrafine nickel powder thereby formed passes through a cooling section together with the resulting gas and is thereafter collected.

A remarkable phenomenon is believed to take place in nickel particles in this process. It is believed that when the nickel halide and the reducing gas are brought into reactive contact with each other, atoms of the resulting nickel or clusters of a monomer are generated, and that ultrafine nickel particles are formed by collision and coalescence of the monomer. The nickel particles are believed to be grown by further collision and coalescence.

Ordinarily, ultrafine powders of copper or silver are not to be compared to nickel because they normally consist of spherical particles. In contrast, nickel powders generally consist of polyhedral particles. With respect to the comparatively large particle sizes, the proportion of surface energy to internal energy is reduced so that the powder tends to develop and possess undesirable crystal habits. In particular, in the case of nickel, particles having distinct cubic or octahedral crystal habits strongly tend to be formed if the particle size is greater than about 0.1 μm. Therefore, it is surprising that the method of this invention is capable of producing a finely divided nickel powder having substantially completely spherical particles even when the particle size is substantially greater than 0.1 μm.

After having fully examined the reaction and generation of fine nickel powders, it has been found that a substantially completely spherical powder can be obtained by reacting the nickel chloride with hydrogen if the nickel chloride vapor density (partial pressure in the supplied gas except for hydrogen) is in the range of about 0.05 to 0.3, and if the reaction/powder generation temperature is within a range from about 0.74 times as high as the melting point of nickel (1,726° K.) in terms of absolute temperature to the nickel melting point, i.e., a range of about 1,004° C. (1,277° K.) to 1,453° C. (1,726° K.) and, further, when the flow rate ratio ($H_2$/($NiCl_2$+inert gas)) between $H_2$ gas and the inert gas containing $NiCl_2$ vapor is about 1 or less. The present invention has been achieved based on this finding.

An important reason for the limitation of the nickel chloride vapor density in the supplied gas to about 0.05 to 0.3 is as described below.

It has been found by experiment that if the nickel chloride vapor density in the supplied gas such as argon is lower than about 0.05, crystal habits are developed and it is not possible to obtain a spherical powder. This may be because the particles grow at a comparatively low speed. If the nickel chloride vapor density exceeds about 0.3, the nickel particles are excessively large and it is not possible to obtain a powder having a desired particle size. Also, if the particle size is excessive crystal habits readily occur.

Most preferably, the nickel chloride vapor density in the supplied gas is about 0.06to 0.15.

The reason for the limitation of the reaction temperature to about 1,004° C. to 1,453° C. is as described below.

If the reaction temperature is lower than about 1004° C., crystal habit particles are mixed and the reaction rate is reduced. The upper limit of the reaction temperature is, preferably, equal to or lower than about the melting point of nickel, i.e., 1,453° C. (1,726° K.). If the reaction temperature is substantially higher than the melting point, generated particles exist in a liquid state, so that the probability of particles growing to a very large size is high, the particle size distribution is extended, and the amount of nickel attached to the reactor wall is increased.

Most preferably, the reaction temperature is about 1,010° C. to about 1,100° C.

It is believed that this temperature dependency of the particle shape relates to the influence of the temperature upon the reaction rate, i.e., the rate of generation of atoms or the metal or monomer clusters, that is, the particle growth speed influences the particle shape. It is explained that if the reaction temperature is higher, the anisotropy of the particle growth is reduced so that the particles tend to grow into spherical bodies. It is considered that the density dependency of the particle shape relates to the influence of the density upon the uniform nuclei formation speed. In this case, it is also believed that the particle shape depends upon the particle growth speed as in the case of the temperature dependency.

In a case where the reaction is carried out in a reaction tube heated in an electric furnace, since this reaction is an exothermic reaction, spherical nickel particles can be attained even if the set temperature of the electric furnace is lower than the predetermined temperature mentioned above, provided that the set temperature is high enough to support the exothermic reaction. That is because it is important to control the temperature at which the nickel particles grow by formation, collision and coalescence of metallic monomers during reaction.

In order to increase the average particle size of the nickel powder, it is important to control the aforementioned $NiCl_2$ density to range between about 0.05 and 0.3 and the reaction temperature to range between about 1004° and 1453° C., while setting the flow rate ratio ($H_2$/($NiCl_2$+inert gas)) between $H_2$ gas and the $NiCl_2$-vapor-containing inert gas to a level not greater than about 1. These three conditions are essential to achieve greater average particle size of nickel powder and to enhance crystallinity.

In particular, it is to be noted that an unstable zone is formed between the $H_2$ gas and the $NiCl_2$-vapor-containing inert gas, so as to impede growth of crystal grains, when the above-mentioned ratio ($H_2$/($NiCl_2$+inert gas)) exceeds about 1, i.e., when the flow rate of the $H_2$ gas is greater than that of the above-mentioned inert gas.

Further, according to the present invention, the nickel content in the nickel powder is controlled to about 99.5% or more by weight, the lower limit of the particle size thereof is about 0.2 μm, the upper limit of the same is smaller than about 3 μm, and the shape of the particles is substantially limited to a spherical shape.

If the nickel content is less than about 99.5% by weight, the desired resistance of electrodes or the desired reliability of electronic parts cannot be achieved due to undesirable influence upon dielectric characteristics. The nickel content is therefore about 99.5% to about 100% by weight.

Particles having a particle size smaller than about 0.2 μm tend to agglomerate easily. If such particles are used as a paste to be printed as internal electrodes of a laminated ceramic capacitor or the like, the filling performance of the filler is very poor so that the electrode layers after being fired are porous, have a high electrical resistance and are reduced in strength of bonding to the dielectric layer, resulting in delamination. In the case of particles having a particle size greater than about 3 μm, it is impossible as a practical matter to reduce the thickness of the electrode layers for physical reasons. It is advisable to have 0.3 and 1 μm as a preferable range.

If the particles are spherical the resulting structure achieves a degree of filling close to optimum density filling when printing internal electrodes, and high-quality electrodes can be obtained by firing which are uniform, in which the amount of voids is small and which electrodes have low resistance. It is also possible to limit the shrinkage of the electrode layers at the time of firing and, hence, to prevent occurrence of cracks in the dielectric layer and delamination.

The geometrical standard deviation of the particle size distribution should be 2.0 or less:

When the geometrical standard deviation of the particle size exceeds 2.0, the thickness of the electrode layer is rendered nonuniform due to inclusion of coarse particles, causing troubles such as delamination and crack formation.

The average grain size should be 0.2 or more times the average particle size:

The grain size of nickel powder as measured by X-ray diffractometry is a factor which indicates crystallinity and affects the degree of ease or difficulty of sintering of nickel powder. More specifically, the smaller the grain size, the easier sintering becomes. When a laminated ceramic capacitor is formed by baking while using nickel powder of small grain size as the material of the electrode layer, the nickel layer may undesirably contract due to an excessive sintering effect, resulting in troubles such as delamination or crack formation.

The inventor has conducted experiments to determine a specific range of grain size which does not cause these troubles and found that delamination and cracking during baking can be avoided when the average grain size is not less than 0.2 times the average particle size where the average particle size ranges between 0.2 and 3.0 μm.

EXAMPLES

The following examples are intended to be illustrative and not to define or to limit the scope of the invention, which is defined in the appended claims.

Example 1

A reactor 1 shown in FIG. 1 was used. A quartz boat 3 of the evaporation section was charged with 10 g of nickel chloride. Nickel chloride was evaporated into argon gas 4 supplied at 10 1/min so that the concentration (partial pressure) of nickel chloride vapor was $8.0\times10^{-2}$. This material mixture gas was transported to a reaction section 5 and controlled at 1050° C. (0.77 times as high as the melting point of nickel in terms of absolute temperature), and brought into contact and reacted with hydrogen supplied from a central nozzle 6 at a rate of 5 1/min. The ratio of the hydrogen flow rate to the argon and the nickel chloride vapor flow rate ($H_2$/($NiCl_2$ vapor+argon gas)) was 0.46. A measurement with a thermocouple 8 protected by a quartz tube indicated that the temperature of the reaction section was increased to 1090° C. (0.79 times as high as the melting point of nickel). The nickel powder thus generated was passed through a cooling section 9 together with the gases, and collected with cylindrical filter paper.

The powder had a specific surface area of 2.7 $m^2$/g. Electron-microscopic observation showed that the average particle size was 0.25 μm and the geometrical standard deviation indicative of the fluctuation of the particle size was 1.4, thus proving a high degree of uniformity of the particle size. According to an electron-microscopic observation of the ultrafine nickel powder of the invention, the shape of the powder was almost perfectly spherical.

The average grain size of this nickel powder as determined by X-ray diffraction was 0.2 μm. Comparing this value with the average particle size, it is understood that the nickel powder of is a single crystal or a polycrystalline powder composed of several crystal grains.

Table 1 shows the results of chemical analysis conducted on the described nickel powder. It will be seen that the nickel powder was substantially free of impurities, although 0.3 wt % of oxygen was contained. Thus, the purity was as high as 99.5 wt % or higher.

Example 2

Nickel powder was prepared under the same conditions as Example 1 except that the concentration of nickel chloride vapor (partial pressure) and the temperature of the reaction section were respectively set to $1.0\times10^{-1}$ and 1070° C. The ratio of the hydrogen flow rate to the argon and the nickel chloride vapor flow rate ($H_2$/($NiCl_2$ vapor +argon gas)) was 0.45.

The nickel powder thus prepared had a specific surface area of 1.7 $m^2$/g, an average particle size of 0.4 μm and a geometrical standard deviation of 1.5. The shape of the powder was almost perfectly spherical. The grain size was 0.2 μm and the purity 99.5 wt % or higher (oxygen 0.2 wt %).

Example 3

Nickel powder was prepared under the same conditions as Example 1 except that the concentration of nickel chloride vapor (partial pressure) and the temperature of the reaction section were respectively set to $1.0\times10^{-1}$ and 1400° C. The ratio of the hydrogen flow rate to the argon and the nickel chloride vapor flow rate ($H_2$/($NiCl_2$ vapor +argon gas)) was 0.45.

The nickel powder thus prepared had a specific surface area of 0.8 $m^2$/g, an average particle size of 0.9 μm and a geometrical standard deviation of 1.7. The shape of the powder was substantially spherical. The grain size was 0.25 μm and the purity 99.5 wt % or higher (oxygen 0.15 wt %).

Example 4

Nickel powder was prepared under the same conditions as Example 1 except that the concentration of nickel chloride vapor (partial pressure) and the temperature of the reaction section were respectively set to $2.0\times10^{-1}$ and 1060° C. The ratio of the hydrogen flow rate to the argon and the nickel chloride vapor flow rate ($H_2$/($NiCl_2$ vapor +argon gas)) was 0.4.

The nickel powder thus prepared had a specific surface area of 1.0 $m^2$/g, an average particle size of 0.6 μm and a geometrical standard deviation of 1.5. The shape of the powder was almost perfectly spherical. The grain size was 0.2 μm and the purity 99.5 wt % or higher (oxygen 0.25 wt %).

Example 5

Nickel powder was prepared under the same conditions as Example 1 except that the concentration of nickel chloride vapor (partial pressure) and the temperature of the reaction section were respectively set to $1.2\times10^{-1}$ and 1070° C. The ratio of the hydrogen flow rate to the argon and the nickel chloride vapor flow rate ($H_2$/($NiCl_2$ vapor +argon gas)) was 0.44.

The nickel powder thus prepared had a specific surface area of 1.3 $m^2$/g, an average particle size of 0.5 μm and a geometrical standard deviation of 1.7. The shape of the powder was almost perfectly spherical. The grain size was 0.15 μm and the purity 99.5 wt % or higher (oxygen 0.25 wt %).

Comparative Example 1

Nickel powder was prepared under the same conditions as Example 1 except that the temperature of the reaction section was set to 1060° C. while the concentration of nickel chloride (partial pressure) was set to $4.0\times10^{-2}$. The ratio of the hydrogen flow rate to the argon and the nickel chloride vapor flow rate ($H_2$/($NiCl_2$ vapor+argon gas)) was 0.48. The nickel powder thus prepared had a specific surface area of 3.2 $m^2$/g, an average particle size of 0.15 μm and a geometrical standard deviation of 1.5. The powder had a cubic or octahedral crystalline habit. The grain size was 0.1 μm and the purity was 99.5 wt % or higher.

Example 6

Nickel powder was prepared under the same conditions as Example 4 except that the hydrogen flow rate was 10 1/min. The ratio of the hydrogen flow rate to the argon and the nickel chloride vapor flow rate ($H_2$/($N_2$ gas+$NiCl_2$ vapor)) was 0.8.

The nickel powder thus prepared had a specific surface area of 1.8 $m^2$/g, an average particle size of 0.3 μm, and a geometrical standard deviation of 1.5. The shape of the powder was almost spherical. The grain size was 0.2 μm and the purity 99.5 wt % or higher (Oxygen 0.3 wt %).

Example 7

Nickel powder was prepared under the same conditions as Example 4 except that the hydrogen flow rate was 4 1/min. The ratio ($H_2$/(argon gas+$NiCl_2$ vapor)) was 0.32.

The nickel powder thus prepared had a specific surface area of 1.0 $m^2$/g, an average particle size of 0.6 μm, and a geometrical standard deviation of 1.5. The shape of the powder was almost spherical. The grain size was 0.2 μm and the purity 99.5 wt % or higher (Oxygen 0.2 wt %).

Comparative Example 2

Nickel powder was prepared under the same conditions as Example 1 except that the temperature of the reaction section was set to 950° C. while the concentration of nickel chloride (partial pressure) was set to $7.0\times10^{-2}$. The ratio of the hydrogen flow rate to the argon and the nickel chloride vapor flow rate ($H_2$/($NiCl_2$ vapor+argon gas)) was 0.465. The nickel powder thus prepared had a specific surface area of 3.3 $m^2$/g, an average particle size of 0.15 μm and a geometrical stand deviation of 1.7. The powder had a cubic or octahedral crystalline habit. The grain size was 0.1 μm and the purity was 99.5 wt %.

Comparative Example 3

Nickel powder was prepared under the same conditions as Example 1 except that the concentration of nickel chloride vapor (partial pressure) and the temperature of the reaction section were respectively set to $4.0\times10^{-1}$ and 1060° C. The ratio of the hydrogen flow rate to the argon and the nickel chloride vapor flow rate ($H_2$/($NiCl_2$ vapor +argon gas)) was 0.3.

The nickel powder thus prepared had a specific surface area of 0.9 $m^2$/g, an average particle size of 1.1 μm and a geometric standard deviation of 2.2. Coarse particles of several μm were contained in the powder. The shape of the powder was substantially spherical. The grain size was 0.3 μm and the purity was 99.5 wt % or higher.

Comparative Example 4

Nickel powder was prepared under the same conditions as Example 4 except that the hydrogen flow rate was 30 1/min. The ratio ($H_2$/(argon gas+$NiCl_2$ vapor)) was 2.4.

The nickel powder thus prepared had a specific surface area of 5.2 $m^2/g$, an average particle size of 0.11 μm, and a geometrical standard deviation of 2.0. The powder had a cubic or octahedral crystalline habit. The grain size was 0.02 μm and the purity 99.5 wt % or higher.

Comparative Example 5

A solution having a Ni ion concentration of 2.5 mol/l and pH of 9.0 was prepared by dissolving nickel sulfate into water. 0.05 mol/l of sodium boron hydride was added as a reducing agent into the solution. The resultant precipitate was separated from the solution and dried in a vacuum to form nickel powder.

The specific surface area of the powder thus obtained was 2.0 $m^2/g$. According to electron-microscopic observation, the powder was granular, with an average particle size of 0.4 μm. The geometrical standard deviation was 1.6, while the grain size was 0.04 μm. The purity was 99.5 wt % or higher.

Comparative Example 6

Nickel powder was prepared by a wet process as in Comparative Example 5. 0.05 mol/l of sodium boron hydride was added as a reducing agent into a solution having a Ni ion concentration of 3.0 mol/l and of pH 9.0 and the resultant precipitate was dried in air to form nickel powder. The specific surface area of the powder thus obtained was 3.1 $m^2/g$. According to electron-microscopic observation, the powder was granular, with an average particle size of 0.5 μm. The geometrical standard deviation was 1.8, while the grain size was 0.08 μm. The purity was 97 wt % (oxygen 1.8 wt %).

Examples 8–14 and Comparative Examples 7 to 12

A laminated ceramic capacitor was produced by using each type of the powders of Examples 1 to 6 and the powders of Comparative Examples 1 to 6. The capacitors of Examples 8 to 14 and Comparative Examples 7 to 12 correspond to those produced by using the nickel powder of Examples 1 to 6 and Comparative Examples 1 to 6, respectively. An examination was conducted to determine the states of occurrence of delamination in the course of firing.

The characteristics of the nickel powders used are summarized in Table 2. In order to form the nickel powder into paste, 2.5 wt % of ethyl cellulose as a binder and 10 wt % of terpineol as a solvent were mixed with 100 wt % of each nickel powder. Each mixture was kneaded by means of a triple-roll mill. This paste was printed in a thickness of 4 μm to form an electrode layer on the surface of a dielectric green sheet of about 30 μm thick. The electrode layer and the dielectric layer was alternately laminated to form 30 layers, and this laminate structure was press-bonded and cut. The cut laminate structure, after dehydration and removal of binder, was fired in a hydrogen-nitrogen gaseous mixture at 1200° C., whereby a laminate capacitor of 3.2 mm long, 2.5 mm wide and 0.9 mm thick was obtained.

30 laminate capacitors thus formed for each type of nickel powder were examined for crack formation or delamination, the results being shown in Table 2. It will be seen that no crack formation or delamination was found in the capacitors formed by using the nickel powders which meet the requirements of the invention. In contrast, the capacitors produced from the nickel powders of the Comparative Examples showed crack formation or delamination due to the fact that the nickel powder did not meet at least one of the requirements of the invention.

TABLE 1

| Chemical Composition (wt %) | | | | | | | | | |
|---|---|---|---|---|---|---|---|---|---|
| Ni | Fe | Co | Mn | Cr | Na | K | Cl | O | C |
| >99.5 | 0.01 | 0.002 | 0.001 | 0.001 | 0.001 | 0.001 | 0.002 | 0.3 | 0.06 |

TABLE 2

| Classification | Particle Size (μm) | Specific Surface Area ($m^2/g$) | Geometrical Standard Deviation Particle Size | Grain Size (μm) | Grain Size/ Particle Size | Purity (%) | Shape | Presence of Crack and/or Delamination |
|---|---|---|---|---|---|---|---|---|
| Example 8 | 0.25 | 2.7 | 1.4 | 0.2 | 0.8 | >99.5 | Spherical | No |
| Example 9 | 0.4 | 1.7 | 1.5 | 0.2 | 0.5 | >99.5 | Spherical | No |
| Example 10 | 0.9 | 0.8 | 1.7 | 0.25 | 0.28 | >99.5 | Substantially Spherical | No |
| Example 11 | 0.6 | 1 | 1.5 | 0.2 | 0.33 | >99.5 | Spherical | No |
| Example 12 | 0.5 | 1.3 | 1.7 | 0.15 | 0.3 | >99.5 | Spherical | No |
| Example 13 | 0.3 | 1.8 | 1.5 | 0.2 | 0.67 | >99.5 | Spherical | No |
| Comp. Ex. 7 | 0.15 | 3.2 | 1.5 | 0.1 | 0.67 | >99.5 | Crystalline Habit Found | Yes |
| Comp. Ex. 8 | 0.15 | 3.3 | 1.7 | 0.1 | 0.67 | 95 | Crystalline Habit Found | Yes |
| Comp. Ex. 9 | 1.1 | 0.9 | 2.2 | 0.3 | 0.27 | >99.5 | Substantially Spherical | Yes |
| Comp. Ex. 10 | 0.11 | 5.2 | 2.0 | 0.02 | 0.18 | >99.5 | Crystalline Habit Found | Yes |
| Comp. Ex. 11 | 0.4 | 2 | 1.6 | 0.04 | 0.1 | >99.5 | Granular | Yes |
| Comp. Ex. 12 | 0.5 | 3.1 | 1.8 | 0.08 | 0.16 | 97 | Granuar | Yes |

Comp. Ex.: Comparative Example

The present invention makes it possible to continuously produce, at a low manufacturing cost, an ultrafine nickel powder which consists of spherical particles having a particle size of about 0.2 to 3 μm highly superior for use as a conductive paste filler, and which contains about 99.5% or more by weight of nickel.

Although the invention has been described with respect to particular reactors, powders and reaction gases and gas mixtures, it will be appreciated that many variations may be made without departing from the spirit and scope of the invention as defined in the appended claims.

What is claimed is:

1. A process for producing ultrafine spherical nickel powder for use in a laminate ceramics capacitor through a vapor phase chemical reaction between nickel chloride and hydrogen, said process comprising the steps of:

i) charging a reaction vessel with said nickel chloride and evaporating said nickel chloride to generate vapor of nickel chloride;

ii) mixing an inert gas with said vapor of the nickel chloride to form a mixture gas having a nickel chloride gas concentration of about 0.05 to about 0.3, and sending said mixture gas to a reaction zone;

iii) bringing, in said reaction zone, said mixture gas into contact and mixing with hydrogen which is supplied from a nozzle at a temperature of about 1004° C. to about 1453° C. at a flow rate of said mixture gas which is decreased by keeping the amount of hydrogen supplied low, such that a flow rate ratio of said hydrogen to said mixture gas meets the condition of $(H_2/(NiCl_2+\text{inert gas})) \leqq 1$, thereby causing said vapor phase chemical reaction;

iv) generating ultrafine spherical nickel powder having a particle size of 0.2 to 3 $\mu$m by said chemical reaction; and v) cooling the generated ultrafine nickel powder together with the mixture gas and collecting said ultrafine nickel powder.

2. A process for producing ultrafine spherical nickel powder according to claim 1, wherein the concentration of said vapor of nickel chloride in said mixture gas is 0.06 to 0.15.

3. A process for producing ultrafine spherical nickel powder according to claim 1, wherein the temperature in said reaction zone is 1010° C. to 1100° C.

4. A process for producing ultrafine spherical nickel powder according to claim 1, wherein the flow rate ratio of said hydrogen to said mixture gas meets the condition of $0.3 \leqq H_2/(NiCl_2+\text{inert gas}) \leqq 0.6$.

5. A process for producing ultrafine spherical nickel powder according to claim 1, wherein said inert gas is selected from the group consisting of argon and nitrogen.

* * * * *

UNITED STATES PATENT AND TRADEMARK OFFICE

CERTIFICATE OF CORRECTION

PATENT NO. : 5,853,451
DATED : December 29, 1998
INVENTOR(S) : Ishikawa

It is certified that error appears in the above-identified patent and that said Letters Patent is hereby corrected as shown below:

In Columns 9 and 10, in Table 2, at the subheading "Classification", after "Example 13", please insert --Example 14--;

at the subheading "Particle Size (μm)", after "0.3", please insert --0.6--;

at the subheading "Specific Surface Area ($m^2/g$)", after "1.8", please insert --1.0--;

at the subheading "Geometrical Standard Deviation Particle Size", after "1.5", please insert --1.5--;

at the subheading "Grain Size (μm)", after "0.2", please insert --0.2--;

at the subheading "Grain Size/Particle Size", after "0.67", please insert --0.33--;

at the subheading "Purity (%)", after ">99.5", please insert -->99.5--;

at the subheading "Shape", after "Spherical", please insert --Spherical--; and at the subheading "Presence of Crack and/or Delamination", after "No", please insert --No--.

Signed and Sealed this

Thirtieth Day of March, 1999

*Attest:*

*Attesting Officer*

Q. TODD DICKINSON

*Acting Commissioner of Patents and Trademarks*